United States Patent [19]

Sato et al.

[11] Patent Number: 4,719,964

[45] Date of Patent: Jan. 19, 1988

[54] METHOD FOR PRODUCING A METAL WIRE

[75] Inventors: Takashi Sato; Tsutomu Ozawa; Toshio Yamada, all of Kawasaki, Japan

[73] Assignee: Nippon Steel Corporation, Tokyo, Japan

[21] Appl. No.: 676,266

[22] Filed: Nov. 29, 1984

[30] Foreign Application Priority Data

Dec. 2, 1983 [JP] Japan ..... 58-227888

[51] Int. Cl.[4] ..... B22D 11/00

[52] U.S. Cl. ..... 164/463; 164/423

[58] Field of Search ..... 164/462, 463, 479, 423, 164/427, 480, 481, 482, 429, 433

[56] References Cited

U.S. PATENT DOCUMENTS

| | | | |
|---|---|---|---|
| 745,786 | 12/1903 | Cole et al. | 164/423 |
| 3,315,349 | 4/1967 | Coffer et al. | 164/482 |
| 3,939,900 | 2/1976 | Polk et al. | 164/423 |

FOREIGN PATENT DOCUMENTS

| | | | |
|---|---|---|---|
| 50-51926 | 5/1975 | Japan . | |
| 55-18582 | 2/1980 | Japan | 164/403 |
| 57-134248 | 8/1982 | Japan . | |

*Primary Examiner*—Nicholas P. Godici
*Assistant Examiner*—G. M. Reid

[57] ABSTRACT

In the method for producing a round metal wire from a melt by using a cooling substrate, the cooling substrate is provided with a groove and melt streams are ejected toward the groove and successively impinge upon a wire while it is in an unsolidified state.

6 Claims, 3 Drawing Figures

METHOD FOR PRODUCING A METAL WIRE

BACKGROUND OF THE INVENTION

1. Field of the Invention

The present invention relates to a method for producing a wire of amorphous metal or crystalline metal or an alloy of amorphous metal or crystalline metal by rapidly cooling and solidifying the metal or alloy melt on the cooling substrate of a rotary chill block or wheel. The metal and alloy are hereinafter collectively referred to as a metal.

2. Description of the Related Art

Heretofore, various kinds of melt spinning methods for continuously producing a wire from molten metal have been disclosed. According to one of the representative metal spinning methods, the melt is ejected through the thin, round orifice of a nozzle and impinges upon the surface of a moving cooling substrate. The so-produced wire has a flat cross section, and, hence, the width is greater than the thickness, this being undesirable for certain applications of the wire.

Japanese Unexamined Patent Publication No. 57-134248 discloses a method of producing a metal wire having a round cross section by flowing molten metal between grooved rolls. This method, however, involves several problems in practice, e.g., accurate guidance of the melt to the grooves and the life of the grooved rolls.

Japanese Unexamined Patent Publication No. 57-134248 discloses a method of producing a round wire by ejecting a melt into a stream of water. This method, however, involves such problems as difficulty in continuous withdrawal of the wire, which is provided with a round shape, from the water and operational trouble due to the use of water.

The melt-pulling-out method (Japanese Unexamined Patent Publication No. 50-51926) and the pendant-drop method (BULLETIN OF THE JAPAN INSTITUTE OF METALS, Vol. 20 (1981), No. 3, page 176) have been proposed for producing a round wire but are disadvantageous because of a low cooling rate. In addition, the shape of the product produced by means of these methods is yet to be improved.

SUMMARY OF THE INVENTION

It is an object of the present invention to provide a method of producing a metal wire from molten metal, by which method there can be produced a metal wire having a round cross section without incurring such disadvantages as in the above-described prior arts during the wire production process.

The present invention provides a cooling substrate which is movable and which is provided with a groove on the surface thereof which extends in the moving direction. The production method using this cooling substrate comprises ejecting a plurality of melt streams and successively superimposing them upon a wire formed in the groove.

The production steps for producing a metal wire comprise:

preparing at least one container having nozzles;

preparing a rotary chill block or wheel having a surface provided with a groove extending in a predetermined direction;

disposing the at least one container above the rotary chill block or wheel and aligning the nozzles in the above-described predetermined direction;

moving the rotary chill body or wheel in the above-mentioned predetermined direction;

holding molten metal in the at least one container and ejecting the molten metal through the nozzles as melt streams;

successively superimposing the melt stream from each nozzle on metal which is positioned in the groove;

cooling the successively superimposed metal in the groove to form a completely solid wire having a round or an essentially round cross section;

and keeping, during the above-mentioned cooling step, the metal in the groove, upon which the melt streams impinge, unsolidified during its subjection to impingement.

By carrying out these steps, a flat thin wire is formed on an upstream portion of the cooling substrate, and the shape of the wire is converted to a round shape during superimposing at a downstream portion. This superimposing is carried out with the metal in the groove being maintained in a molten state. This can be attained by determining the distance between the nozzles.

The present invention is now explained with reference to the drawings.

BRIEF DESCRIPTION OF THE DRAWINGS

FIGS. 1(A) and 1(B) are a side view and a plan view, respectively, of the melt streams and the cooling substrate.

DESCRIPTION OF THE PREFERRED EMBODIMENTS

Figure 1A:
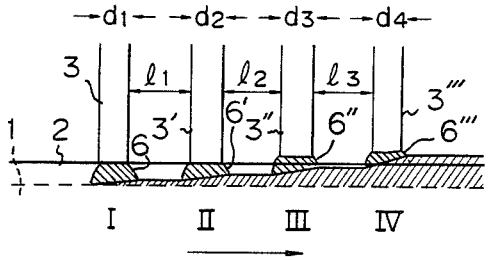
FIGS. 1(A) and 1(B) schematically illustrate the method of the present invention.
Figure 1B:
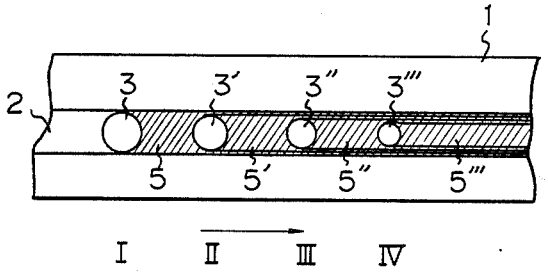
Figure 2:
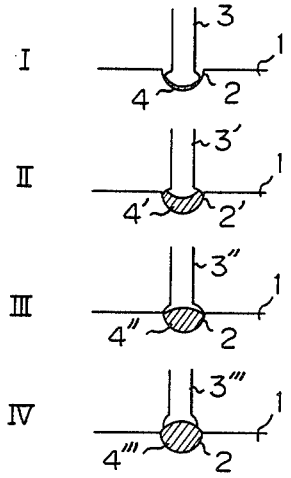
FIG. 2 schematically illustrates the superimposing of the melt streams.

Referring to FIGS. 1(A) and 1(B), the cooling substrate 1 of a rotary chill block or wheel moves in the predetermined direction denoted by the arrow and has a groove 2 on the surface thereof. The rotary chill block or wheel may be an annular chill roll having a groove 2 on the outer peripheral surface in the case of a single roll method or having a groove 2 on the inner peripheral surface thereof in the case of a centrifugal quenching method. A container (not shown) is disposed above the cooling base 1 and holds the molten metal therein. The nozzles 3, 3', 3'', 3''' of the container are aligned in the predetermined direction and face the groove 2. When the molten metal is ejected through the nozzles 3, 3', 3'', 3''', it stagnates or remains in the groove 2 so that melt reservoirs 4, 4', 4'', 4''' (FIG. 2) are formed. Fine wires 5, 5', 5'', 5''' are withdrawn or pulled from the melt reservoirs 4, 4', 4'', 4''' and are unsolidified. The melt reservoirs are hereinafter referred to as puddles.

Of the nozzles 3—3''', the nozzle 3 is positioned the farthest upstream. The molten metal ejected through the nozzle 3 impinges upon the bottom of the groove 2 in the cooling substrate 1 and forms the first puddle 4 on the groove bottom. The first fine wire 5 withdrawn or pulled from the first puddle 4 has a flat shape, and the molten metal from the next upstream nozzle 3' is imposed on the fine wire 5 while the wire 5 is still in a molten state. The first fine wire 5 is pressed against the cooling base 1 by the melt stream from the second nozzle 3'. Simultaneously, the second fine wire 5', which is withdrawn or pulled from the second puddle 4', is superimposed on and is integrally united with the first fine wire 5. The third and subsequent melt streams can be superimposed on the integral fine wires 5, 5', if necessary. During superimposition of the melt streams, the cross-sectional area of the wire is increased, and the cross section of the wire maintains a shape identical to that of the groove 2 until the melt overflows the groove 2.

Suitably the melt puddles diminish in size in the moving direction of the rotary chill block. See puddles 6, 6', 6'', 6''' of FIG. 1A.

In order to produce a wire having a round cross section, the groove 2 has a semicircular cross section. When the groove 2 is filled with the melt after the pouring of several melt streams into the groove 2, the pouring of the remaining melt streams is carried out so that the cross-sectional shape of the wire is controlled in accordance with control of the puddle shape. Wire-shape control is attained not by the shape of the groove 2 but by control of the puddles. Wire-shape control can be carried out by successively diminishing some of the puddles, e.g., puddle 4''' and a puddle(s) formed downstream of puddle 4'''. Wire-shape control is also attained by the control of the surface tension of molten metal for providing a round top side of the wire, that is, the roundness of the topside of a wire is caused by the surface tension of molten metal. As is apparent from FIGS. 2I through 2IV, the wire is converted from a flat shape (FIG. 2I) to an essentially round shape (FIG. 2IV) due to the superimposing of the melt streams. This superimposing provides the control of the surface tension and/or diminishing of the puddles 4—4'''.

The cooling substrate 1 is a solid cooling means, i.e., it is not a liquid cooling means used conventionally for producing a round wire. The production of a round wire by the use of the cooling plate is attained by the superimposing described above. Such superimposing attains not only a gradual increase in the thickness of a wire but also enhancement of the thermal contact between the wire and the cooling plate, with the result that a round wire can be produced.

The preferred conditions for producing a wire having a round or oval cross section are now described.

The melt streams should have a round or oval cross section and a diameter smaller than the width of the groove. The distance between the melt streams should be sufficiently greater than the value at which the puddles formed by the respective melt streams are superimposed on one another and should be sufficiently less than the value at which the melt streams are superimposed on an underlying wire in which solidification has been completed so as to provide an integral body of the melt streams and the underlying wire. The preferred distance between the adjacent melt streams depends upon the diameter of the orifice or slot of the respective nozzles, the distance between the nozzles and the cooling substrate, the ejection pressure, the moving speed of the cooling substrate, the width of the groove, and the like. If the orifice diameter is from 0.2 to 0.8 mm, the distance between the adjacent melt streams is from 0.3 to 3 mm. The distance between the nozzles and the cooling substrate is optional provided that the melt streams are not converted to liquid droplets while dropping or falling such a distance.

The relative position of the nozzles and the cooling substrate is important for adjusting the wire shape. The relative position should be such that the puddles are brought into the central portion of the groove, that is, the melt streams from the nozzles should impinge on the underlying wire at the center of the wire. The ejection angle of the melt streams may be slanted or perpendicular to the surface of the cooling substrate. The ejection angle and the position of the nozzles' orifices and the like should be predetermined so that the melt streams form puddles at the center of the groove.

A wire produced by the method of the present invention generally does not have a cross section of a complete roundness. A wire with a roundness of 0.50 or more can be produced by the method of the present invention. The roundness of the wire can be enhanced, if necessary, by subjecting the wire produced by casting to drawing. Dimensional accuracy can also be produced by such drawing. If the cooling substrate has a flat bottom surface the wire having a semispherical cross section is produced.

A round or oval wire, made of amorphous and crystalline metals can have a longer diameter of from 0.1 to 1 mm and can be used for magnetic application, composite filler, a wire rope, and other structural uses utilizing the strength of a wire(s). In these applications, if a high roundness and/or dimension accuracy is required, the round or oval wire is drawn.

The present invention is now explained by way of examples.

EXAMPLE 1

A container having four nozzles 3—3''' (FIG. 1) was used. The orifice diameters $d_1$ and $d_2$ of the first two nozzles 3, 3' were 0.4 mm ($d_1=d_2=0.4$ mm), the orifice diameter $d_3$ of the third nozzle 3'' was 0.3 mm ($d_3=0.3$ mm), and the orifice diameter $d_4$ of the fourth nozzle 3''' was 0.25 mm ($d_4=0.25$ mm). The groove 2 having a semicircular cross section and a diameter of 0.5 mm was formed around a single roll made of copper alloy.

A wire having an $Fe_{80.5}Si_{6.5}B_{12}C_1$ composition (atomic %) was produced by using a single roll under the following conditions:

ejection pressure: 0.5 kg/cm$^2$ circumferential speed of roll: 25 m/sec

The produced wire was of an oval form and had a long diameter of 0.5 m and a short diameter of 0.4 mm. The wire exhibited such a degree of flexibility that it was not fractured when it was wound around a pipe having an outer diameter of 10 mm.

EXAMPLE 2

A container having six nozzles was used. The orifice diameters $d_1, d_2, \ldots, d_6$ numbered in the downstream direction were as follows: $d_1=d_2=d_3=0.5$ mm; $d_4=0.4$ mm; $d_5=0.35$ mm; and $d_6=0.30$ mm. The distance between the nozzles was 1 mm. A groove having a semicircular cross section and a diameter of 1 mm was formed around a single roll made of iron.

A stainless steel wire having a chemical composition of 16.5% of Cr, 0.06% of C, 0.6% of Si, 0.5% of Mn, 0.025; % of P, and 0.005% of S was produced using the single roll under the following conditions:

distance between roll surface and nozzle surface: 0.3 mm ejection angle of melt stream: perpendicular to roll surface ejection pressure: 0.5 kg/cm$^2$ circumferential speed of roll: 25 m/sec.

The produced wire was of an oval form and had a long diameter of 1 mm and a short diameter of 0.7 mm. The wire, i.e., the cast wire, was drawn with dies having a caliber of 0.5 mm to form a round wire 0.5 mm in diameter.

We claim:

1. A method for producing a metal wire having a round or virtually round cross section, comprising the steps of:

preparing a rotary chill block or wheel having a surface provided with a groove extending in a predetermined direction;

preparing at least one container having at least two nozzles, with each nozzle having an orifice diameter of from 0.2 to 0.8 mm and arranged at a distance such that a distance between adjacent metal streams is from 0.3 to 3 mm;

disposing said at least one container above said movable rotary chill block or wheel and aligning the nozzles in registry with such groove in a line parallel to said predetermined direction wherein at least some of said nozzles have orifice diameters of different dimensions with the dimensions of said orifice diameters decreasing in size along said predetermined direction;

moving said rotary chill block or wheel in said predetermined direction;

holding molten metal in said at least one container;

ejecting the molten metal through the nozzles as the melt streams, thereby forming a flat wire in the groove by the melt stream ejected from the most upstream nozzle;

successively superimposing said melt stream from each downstream nozzle on flat metal which is ejected from the most upstream nozzle and is positioned in the groove, while this metal is unsolidified, thereby increasing a cross section of the wire; and cooling the successively superimposed metal in the groove to form a completely solid wire having a round or an essentially round cross section.

2. A method according to claim 1, wherein said groove has a semicircular cross section.

3. A method according to claim 1 or 2, wherein the puddles formed by stagnations of the melt streams on the metal in the groove are successively diminished in size in the moving direction.

4. A method according to claim 1, wherein the distance between the neighboring nozzles is adjusted to form separate melt streams and to keep the metal being impinged unsolidified.

5. A method according to claim 3, wherein a plurality of melt streams are ejected into the groove to form a wire having a thickness approximately equal to the depth of the groove and then a plurality of melt streams are ejected on said wire while diminishing the puddles in size in said moving direction.

6. A method according to claim 1, wherein the completely solid wire is subjected to drawing.

* * * * *